US007272555B2

(12) United States Patent
Lee et al.

(10) Patent No.: US 7,272,555 B2
(45) Date of Patent: Sep. 18, 2007

(54) FINE GRANULARITY SCALABILITY SPEECH CODING FOR MULTI-PULSES CELP-BASED ALGORITHM

(75) Inventors: I-Hsien Lee, Taipei (TW); Fang-Chu Chen, Taipei (TW)

(73) Assignee: Industrial Technology Research Institute, Taipei (TW)

( * ) Notice: Subject to any disclaimer, the term of this patent is extended or adjusted under 35 U.S.C. 154(b) by 926 days.

(21) Appl. No.: 10/627,629

(22) Filed: Jul. 28, 2003

(65) Prior Publication Data

US 2004/0024594 A1 Feb. 5, 2004

Related U.S. Application Data

(63) Continuation-in-part of application No. 09/950,633, filed on Sep. 13, 2001, now Pat. No. 6,996,522.

(60) Provisional application No. 60/416,522, filed on Oct. 8, 2002.

(51) Int. Cl.
*G10L 19/04* (2006.01)
*G10L 13/04* (2006.01)

(52) U.S. Cl. ..... 704/219; 704/223; 704/220; 704/264

(58) Field of Classification Search ..... 704/219, 704/223, 229, 264, 238, 267, 220, 222, 200.2, 704/203, 207, 212, 236, 208, 214, 200.1
See application file for complete search history.

(56) References Cited

U.S. PATENT DOCUMENTS 5,495,555 A * 2/1996 Swaminathan ..... 704/207
5,966,689 A * 10/1999 McCree ..... 704/226
6,055,496 A * 4/2000 Heidari et al. ..... 704/222
6,108,626 A * 8/2000 Cellario et al. ..... 704/230
6,148,288 A * 11/2000 Park ..... 704/500
6,182,030 B1 * 1/2001 Hagen et al. ..... 704/201
6,263,307 B1 * 7/2001 Arslan et al. ..... 704/226
6,687,666 B2 * 2/2004 Ehara et al. ..... 704/207
6,732,070 B1 * 5/2004 Rotola-Pukkila et al. ... 704/219

(Continued)

OTHER PUBLICATIONS

Fang-Chu Chen, "Suggested new bit rates for ITU-T G.723.1," Electronic Letters, vol. 35, No. 18, Sep. 2, 1999, pp. 1-2.

(Continued)

*Primary Examiner*—Vijay Chawan
(74) *Attorney, Agent, or Firm*—Finnegan, Henderson, Farabow, Garrett & Dunner LLP

(57) ABSTRACT

A method for speech processing in a code excitation linear prediction (CELP) based speech system having a plurality of modes including at least a first mode and a consecutive second mode. The method includes providing an input speech signal, dividing the speech signal into a plurality of frames, dividing at least one of the plurality of frames into sub-frames including a plurality of pulses, selecting a first number of pulses for the first mode, with a second number of remaining pulses in the frame plus the first number of pulses in the first mode for the second mode, providing a plurality of sub-modes between the first mode and the second mode, forming a base layer, forming an enhancement layer, generating a bit stream including a basic bit stream and an enhancement bit stream, wherein the basic bit stream is used to update memory states of the speech system.

23 Claims, 12 Drawing Sheets

U.S. PATENT DOCUMENTS 6,996,522 B2 * 2/2006 Chen ..... 704/219
7,024,355 B2 * 4/2006 Nomura ..... 704/221
7,117,146 B2 * 10/2006 Gao ..... 704/200.1

OTHER PUBLICATIONS

ISO/IEC JTC1/SC29/WG11, "Information Technology—Generic Coding of Audio-Visual Objects: Visual," ISO/IEC 14496-2 / Amd X, Working Draft 3.0, Draft of Dec. 8, 1999.

ITU-T Recommendation G. 723 1, International Telecommunication Union.

Weiping Li, "Overview of Fine Granularity Scalability in MPEG-4 Video Standard," IEEE Transactions on Circuits and Systems for Video Technology, vol. 11, No. 3, pp. 301-317, Mar. 2001.

Fang-Chu Chen, "Suggested new bit rates for ITU-T G.723.1," Electronics Letters, vol. 35, No. 18, pp. 1523-1524, Sep. 2, 1999.

3GPP TS 26.190, "AMR Wideband speech codec; Transcoding functions," version 5.1.0, Dec. 2001.

3GPP TS 26.090, "AMR speech codec; Transcoding functions," version 4.0.0, Mar. 2001.

"Information Technology—Coding of Audio-Visual Objects—Part 2: Visual Amendment 1: Visual Extensions," ISO/IEC JTC 1/SC 29/WG 11 N 3056, Dec. 2000.

* cited by examiner

FINE GRANULARITY SCALABILITY SPEECH CODING FOR MULTI-PULSES CELP-BASED ALGORITHM

RELATED APPLICATION

The present application is a continuation-in-part application of, and claims priority to, U.S. patent application Ser. No. 09/950,633, filed Sep. 13, 2001, entitled "Methods and Systems for CELP-Based Speech Coding with Fine Grain Scalability." This application is also related to, and claims the benefit of priority of, U.S. Provisional Application No. 60/416,522, filed Oct. 8, 2002, entitled "Fine Grain Scalability Speech Coding for Multi-Pulses CELP Algorithm." These related applications are expressly incorporated herein by reference.

DESCRIPTION OF THE INVENTION

1. Field of the Invention

The present invention is generally related to speech coding and, more particularly, to methods and systems for realizing a CELP-based (Code Excited Linear Prediction) scalable speech codec with fine granularity scalability.

2. Background of the Invention

One major design consideration in current multimedia developments is flexible bandwidth usage, or bit rate scalability, in a transmission channel, because the bandwidths available to different users and to a particular user at different times are generally different and unknown at the time of encoding. A codec (coder-decoder) is considered to have bit rate scalability when the encoder produces a bit stream having a plurality of bit blocks, and the decoder can reconstruct the signal with a minimum amount of bit blocks, but as more blocks of bits are received, the synthesized signal has a higher quality.

Layer scalable coding has been proposed to provide scalable bit rates for multimedia systems. A conventional layer scalable coding method divides a bit stream representing a multimedia signal into a base layer and one or more enhancement layers, wherein the base layer provides a minimum quality when received at the receiver, while the enhancement layers, if received, may improve the quality of the re-constructed multimedia signal.

In a system utilizing such a layer scalable coding method, the minimum quality information of the signal is first computed to form the base layer, estimates of the error of such minimum quality information compared to the original signal are calculated to form the enhancement layers. If more than one enhancement layer is used, then a second enhancement layer is generated based on the error of a synthesized speech signal using the base layer and the first enhancement layer. Therefore, such a conventional layer scalable coding method requires calculation for the base layer first and then for each of the enhancement layer, each being a coding flow. Such a calculation procedure is complex, which limits the number of enhancement layers in practical usage. Therefore, the layer scalable coding method generally only provides no more than a few enhancement layers, which may not be sufficient for many applications.

A coding structure with fine granularity scalability ("FGS") including a base layer and only one enhancement layer has been introduced to increase the bit rate scalability. "Fine granularity" means that the enhancement bit stream can be discarded with arbitrary number of bits, in contrast to discarding a layer at a time in layer scalable coding. Therefore, the bit rate may be modified arbitrarily according to the bandwidth available to the receiver. With an existing FGS algorithm, the enhancement layers are distinguished by the different bit significance levels such that a bit plane or a bit array is sliced from the spectral residual. The enhancement layers are also arranged such that those containing information of lesser importance are placed closer to the end of the bit stream so that they may be discarded. Accordingly, when the length of the bit stream to be transmitted is shortened, the enhancement layers at the end of the bit stream, i.e., those with the least bit significance levels, are discarded first.

General audio and video coding algorithms with FGS have been adopted as part of the MPEG-4 standard, the international standard (ISO/IEC 14496). However, the conventional FGS has not been successfully implemented with a high-parametric codec having a high compression rate, such as the CELP-based speech codec. These speech codecs, e.g., ITU-T G.729, G.723.1, and GSM (Global System for Mobile communications) speech codecs, use linear predictive coding (LPC) model to encode the speech signal instead of encoding it in spectral domain. As a result, these codecs cannot use the existing FGS approach to encode the speech signal.

The coded speech stream also requires rate scalability in response to the channel rate variation. For example, a 3GPP AMR-WB (Third Generation Partnership Project Adaptive Multi-Rate Wideband) speech coder includes nine modes, each mode corresponding to a different coding scheme, with the bit rate difference between two adjacent modes varying from 0.8 kbps to 3.2 kbps. However, there are applications that may require bit rate gaps between two modes, for example, to provide the network supervisor with a higher adaptation flexibility (finer grain), or to transmit a small amount of non-voice data within the voice band. To transmit a small amount of non-voice data, conventional methods include short message service (SMS) and multimedia messaging service (MMS). These services have been implemented in current mobile systems and standardized in 3GPP. However, SMS is not a real-time service, and MMS is not cost effective.

SUMMARY OF THE INVENTION

In accordance with the present invention, there is provided a method for speech processing in a code excitation linear prediction (CELP) based speech system having a plurality of modes including at least a first mode and a consecutive second mode, including providing an input speech signal, dividing the speech signal into a plurality of frames, dividing at least one of the plurality of frame into sub-frames including a plurality of pulses, selecting a first number of pulses for the first mode, with a second number of remaining pulses in the frame plus the first number of pulses in the first mode to form the second mode, providing a plurality of sub-modes between the first mode and the second mode, wherein the sub-mode contains a third number of pulses include at least all the pulses in the first mode and wherein the third number of pulses in the sub-mode is generated by dropping a portion of the generated pulses in the second mode, forming a base layer including the first number of pulses, forming an enhancement layer including the second number of the remaining pulses, generating a bit stream including a basic bit stream and an enhancement bit stream, including generating linear prediction coding (LPC) coefficients, generating pitch-related information, generating pulse-related information, forming a basic bit stream including the LPC coefficients, the pitch-related information, and the pulse-related information of the pulses in the base layer, and forming an enhancement bit stream including the pulse-related information of the pulses in the enhancement layer, wherein the basic bit stream is used to update memory states of the speech system.

Also in accordance with the present invention, there is provided a method for transmitting non-voice data together with voice data over a voice channel having a fixed bit rate, including providing an amount of non-voiced data, providing a speech signal to be transmitted over the voice channel, dividing the speech signal into a plurality of frames, dividing at least one of the plurality of frames into sub-frames including a plurality of pulses, selecting a first number of pulses for the first mode, with a second number of the plurality pulses remaining in the frame plus the first number of pulses in the first mode to form the second mode, providing a plurality of sub-modes between the first mode and the second mode, wherein the sub-mode contains the third number of pulses include at least all the pulses in the first mode and wherein the third number of pulses in the sub-mode is generated by dropping a portion of the generated pulses in the second mode, forming a base layer including the first number of pulses, forming an enhancement layer including the second number of remaining pulses, forming a first bit stream including a basic bit stream and an enhancement bit stream, forming the second bit stream with the fixed bit rate by including the first bit stream and the an amount of the non-voice data, and transmitting the second bit stream. Forming the first bit stream also includes generating linear prediction coding (LPC) coefficients, generating pitch-related information, generating pulse-related information for all of the second number of pulses, forming the basic bit stream including the LPC coefficients, the pitch-related information, and the pulse-related information of each pulse in the base layer, selecting one of the sub-modes, and forming the enhancement bit stream including the pulse-related information of the pulses in the selected sub-mode.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings provide a further understanding of the invention and are incorporated in and constitute a part of this specification. The drawings illustrate various embodiments of the invention and, together with the description, serve to explain the principles of the invention.

DESCRIPTION OF THE EMBODIMENTS

The following detailed description refers to the accompanying drawings. Although the description includes exemplary implementations, other implementations are possible and changes may be made to the implementations described without departing from the spirit and scope of the invention. The following detailed description does not limit the invention. Instead, the scope of the invention is defined by the appended claims. Wherever possible, the same reference numbers will be used throughout the drawings and the following description to refer to the same or like parts.

The methods and systems of the present invention provide a coding scheme with fine granularity scalability ("FGS"). Specifically, embodiments of the present invention provide a CELP-based speech coding with FGS. In a CELP-based codec, a human vocal track is modeled as a resonator. This is known as an LPC model and is responsible for the vowels. A glottal vibration is modeled as an excitation, which is responsible for the pitch. That is, the LPC model excited by periodic excitation signals can generate a synthetic speech. Additionally, the residual due to imperfections of the model and limitations of the pitch estimate is compensated with fixed-code pulses, which are responsible for consonants. The FGS is realized in the CELP coding on the basis of the fixed-code pulses in a manner consistent with the present invention.

Figure 1:
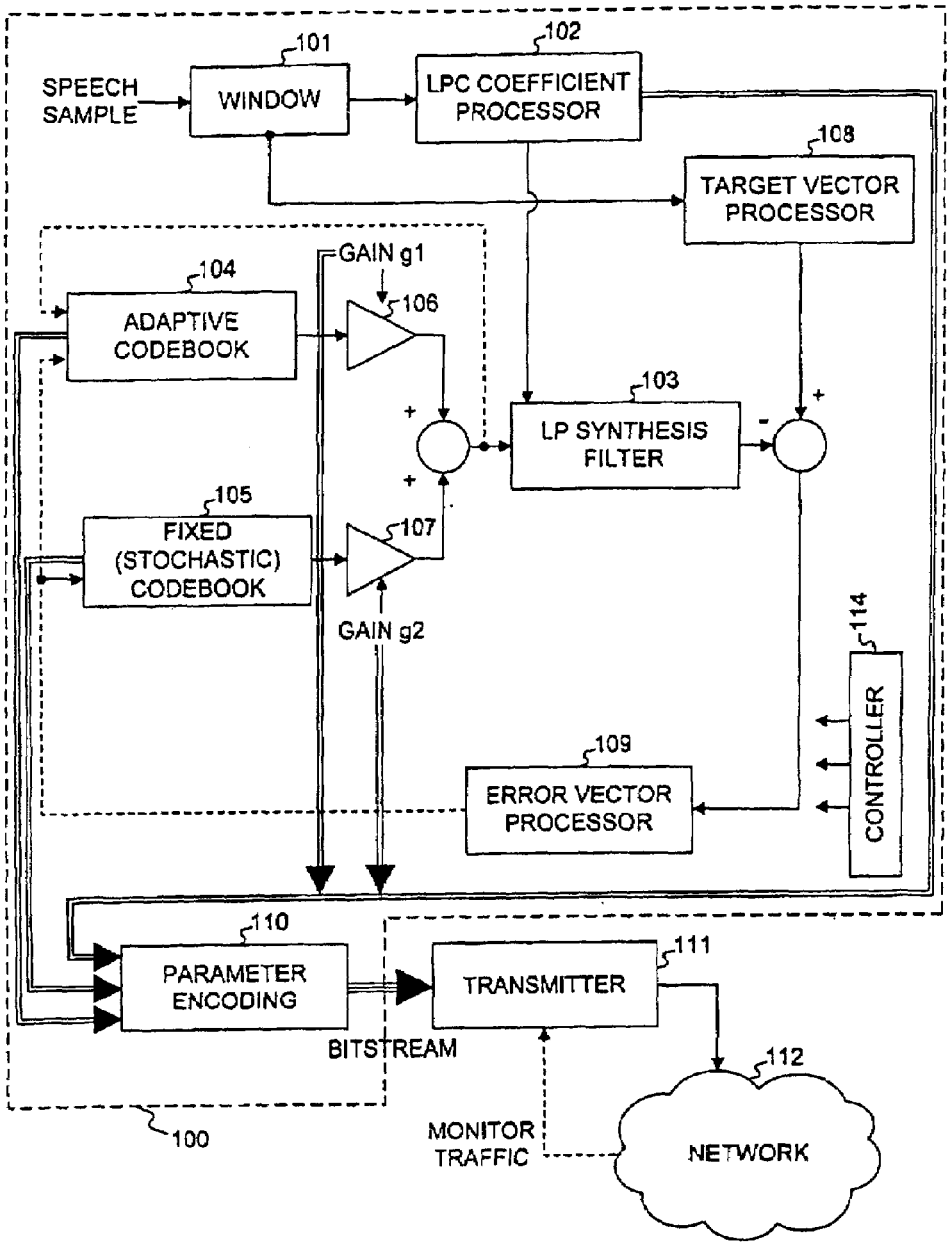
FIG. 1 is a block diagram of a speech encoder consistent with one embodiment of the present invention.

FIG. 1 is a block diagram of a CELP-type encoder 100 consistent with one embodiment of the present invention. Referring to FIG. 1, a sample speech is divided into a plurality of frames and provided to window 101 to perform a windowing function. An LPC-analysis is performed on the windowed speech. The windowed speech is provided to an LPC coefficient processor 102 to calculate LPC coefficients based on the speech frame. The LPC coefficients are provided to an LP synthesis filter 103. In addition, the speech frame is divided into sub-frames, and an analysis-by-synthesis is performed based on each sub-frame.

In an analysis-by-synthesis loop, LP synthesis filter 103 is excited by an excitation vector having an adaptive part and a stochastic part. The adaptive excitation is provided as an adaptive excitation vector from an adaptive codebook 104, and the stochastic excitation is provided as a stochastic excitation vector from a fixed (stochastic) codebook 105.

The adaptive excitation vector and the stochastic excitation vector are scaled by amplifier 106 and by amplifier 107, respectively, and provided to a summer (not numbered). Amplifier 106 has a gain of g1 and amplifier 107 has a gain of g2. The sum of the scaled adaptive and stochastic excitation vectors are then filtered by LP synthesis filter 103 using the LPC coefficients calculated by LPC coefficient processor 102. An error vector is produced by comparing the output from LP synthesis filter 103 with a target vector generated by a target vector processor 108 based on the windowed sample speech from window 101. An error vector processor 109 then processes the error vector, and provides an output, through a feedback loop, to codebooks 104 and 105 to provide vectors and determine optimum g1 and g2 values to minimize errors. Through the adaptive and fixed codebook searchs, the excitation vectors and gains that give the best approximation to the sample speech are chosen.

Encoder 100 also includes a parameter encoding device 110 that receives, as inputs, LPC coefficients of the speech frame from LPC coefficient processor 102, adaptive code pitch information from adaptive codebook 104, gains g1 and g2, and fixed-code pulse information from stochastic codebook 105. The adaptive code pitch information, gains g1 and g2, and fixed-code pulse information correspond to the best excitation vectors and gains for each sub-frame. Parameter encoding device 110 then encodes the inputs to create a bit stream. This bit stream, which includes a basic bit stream and an enhancement bit stream, is transmitted by a transmitter 111 to a decoder (not shown) in a network 112 to decode the bit stream into a synthesized speech.

In accordance with the present invention, the basic bit stream includes the (a) LPC coefficients of the frame, (b) adaptive code pitch information and gain g1 of all the sub-frames, and (c) fixed-code pulse information and gain g2 of even sub-frames. The enhancement bit stream includes (d) the fixed-code pulse information and gain g2 of odd sub-frames. The fixed-code pulse information includes, for example, pulse positions and pulse signs. Hereinafter, the adaptive code pitch information and gain g1 of all the sub-frames of item (b) is referred to as "pitch lag/gain." The fixed-code pulse information and gain g2 of even and odd sub-frames of items (c) and (d) are hereinafter referred to as "stochastic code/gain."

For the FGS, the basic bit stream is the minimum requirement and is transmitted to the decoder to generate an acceptable synthesized speech. The enhancement bit stream, on the other hand, can be ignored, but is used in the decoder for speech enhancement over the minimally acceptable synthesized speech. When a variation of the speech between two adjacent sub-frames is slow, the excitation of the previous sub-frame can be reused for the current sub-frame with only pitch lag/gain updates while retaining comparable speech quality.

More specifically, in the analysis-by-synthesis loop of the CELP coding, the excitation of the current sub-frame is first extended from the previous sub-frame and later corrected by the best match between the target and the synthesized speech. Therefore, if the excitation of the previous sub-frame is guaranteed to generate acceptable speech quality of that sub-frame, the extension, or reuse, of the excitation with pitch lag/gain updates of the current sub-frame leads to the generation of speech quality comparable to that of the previous sub-frame. Consequently, even if the stochastic code/gain search is performed only for every other sub-frame, acceptable speech quality can still be achieved by only using pulses in even sub-frames.

Table 1 shows the bit allocation according to the 5.3 kbit/s G.723.1 standard and that of the basic bit stream in the present embodiment. In the entries wherein two numbers are shown, for example, the GAIN for Subframe 1, the upper number (12) represents the bit number required by the G.723.1 standard, and the lower number (8) represents the bit number of the basic bit stream in accordance with the embodiment of the present invention. The pitch lag/gain (adaptive codebook lags and 8-bit gains) is determined for every sub-frame, whereas the stochastic code/gain (the remaining 4-bit gains, pulse positions, pulse signs and grid index) of even sub-frames is included in the basic bit stream. When only this basic bit stream is received, the excitation signal of the odd sub-frame is constructed through SELP (Self-code Excitation Linear Prediction) derived from the previous even sub-frame without referring to the stochastic codebook. Therefore, for the basic bit stream of the present invention, there need not be any bits for the Pulse positions (POS), Pulse signs (PSIG), and Grid index (GRID) for the odd number sub-frames.

TABLE 1

| Parameters coded | Subframe 0 | Subframe 1 | Subframe 2 | Subframe 3 | Total |
|---|---|---|---|---|---|
| LPC indices (LPC) | | | | | 24 |
| Adaptive code-book lags (ACL) | 7 | 2 | 7 | 2 | 18 |
| All gains | 12 | 12 | 12 | 12 | 48 |
| combined (GAIN) | | 8 | | 8 | 40 |
| Pulse positions | 12 | 12 | 12 | 12 | 48 |
| (POS) | | 0 | | 0 | 24 |
| Pulse signs | 4 | 4 | 4 | 4 | 16 |
| (PSIG) | | 0 | | 0 | 8 |
| Grid index | 1 | 1 | 1 | 1 | 4 |
| (GRID) | | 0 | | 0 | 2 |
| Total | | | | | 158 |
| | | | | | 116 |

As can be seen from Table 1, for the basic bit stream of the present invention, the total number of bits is reduced from 158 of the G.723.1 standard to 116, and the bit rate is reduced from 5.3 kbit/s to 3.9 kbit/s, which translates into a 27% reduction. In addition, the basic bit stream of the present invention generates speech with only approximately 1 dB SEGSNR (SEGmental Signal-to-Noise Ratio) degradation in quality compared to the full bit stream of the G.723.1 standard. Therefore, the basic bit stream of the present invention satisfies the minimum requirement for synthesized speech quality.

For bit rate scalability, the basic bit stream is followed by a number of enhancement bit streams. However, the subsequent enhancement bit streams of the present invention are dispensable either in whole or in part. The enhancement bit streams carry the information about the fixed code vectors and gains for odd sub-frames, and represent a plurality of pulses. As the information about more of the pulses for odd sub-frames is received, the decoder can output speech with higher quality. In order to achieve this scalability, the bit ordering in the bit stream is rearranged, and the coding algorithm is partially modified, as described in detail below.

Table 2 shows an example of the bit reordering of the low bit rate coder. The number of total bits in a full bit stream of a frame and the bit fields are the same as that of a standard codec. The bit order, however, is modified to provide flexibility of bit rate transmission. Generally, bits in the basic bit stream are transmitted before the enhancement bit stream. The enhancement bit streams are ordered so that bits for pulses of one odd sub-frame are grouped together, and that, within one odd sub-frame, the bits for pulse signs (PSIG) and gains (GAIN) precede the pulse positions (POS). With this new order, pulses are abandoned in a way that all the information of one sub-frame is discarded before another sub-frame is affected.

TABLE 2

| | Transmitted octets | Bit order |
|---|---|---|
| BASIC BITSTREAM | 1 | LPC B5…LPC B0, VADFLAG_B0, RATEFLAG_B0 |
| | 2 | LPC_B13…, LPC_B6 |
| | 3 | LPC_B21…LPC_B14 |
| | 4 | ACL0_B5…ACL0_B0, LPC_B23, LPC_B22 |
| | 5 | ACL2_B4…ACL2_B0, ACL1_B1, ACL1_B0, ACL0_B6 |
| | 6 | GAIN0_B3…GAIN0_B0, ACL3_B1, ACL3_B0, ACL2_B6, ACL2_B5 |
| | 7 | GAIN0_B11…GAIN0_B4 |
| Reorder | 8 | GAIN1_B11…GAIN1_B4 |
| | 9 | GAIN_B7…GAIN2_B0 |
| | 10 | GAIN3_B7…GAIN3_B4, GAIN2_B11…GAIN2_B8 |
| | 11 | PSIG0_B1, PSIG0_B0, GRID2_B0, GRID0_B0, GAIN3_B11…GAIN3_B8 |
| | 12 | POS0_B1, POS0_B0, PSIG2_B3…PSIG2_B0, PSIG0_B3, PSIG0_B2 |
| | 13 | POS0_B9…POS0_B2,W, |
| | 14 | POS2_B5…POS2_B0, POS0_B11, POS0_B10 |
| | 15-1 | POS2_B11…POS2_B6 |
| ENCHANCEMENT BITS | 15-2 | GAIN1_B1, GAIN1_B0 |
| | 16 | POS1_B0, PSIG1_B3…PSIG1_B0, GRID1_B0, GAIN1_B3, GAIN1_B2 |
| | 17 | POS1_B8…POS1_B1 |
| | 18 | GRID3_B0, GAIN_B3…GAIN3_B0, POS1_B11…POS1_B9 |
| | 19 | POS3_B3…POS3_B0, PSIG3_B3…PSIG3_B0 |
| | 20 | POS3_B11…POS3_B4, |

Figure 2:
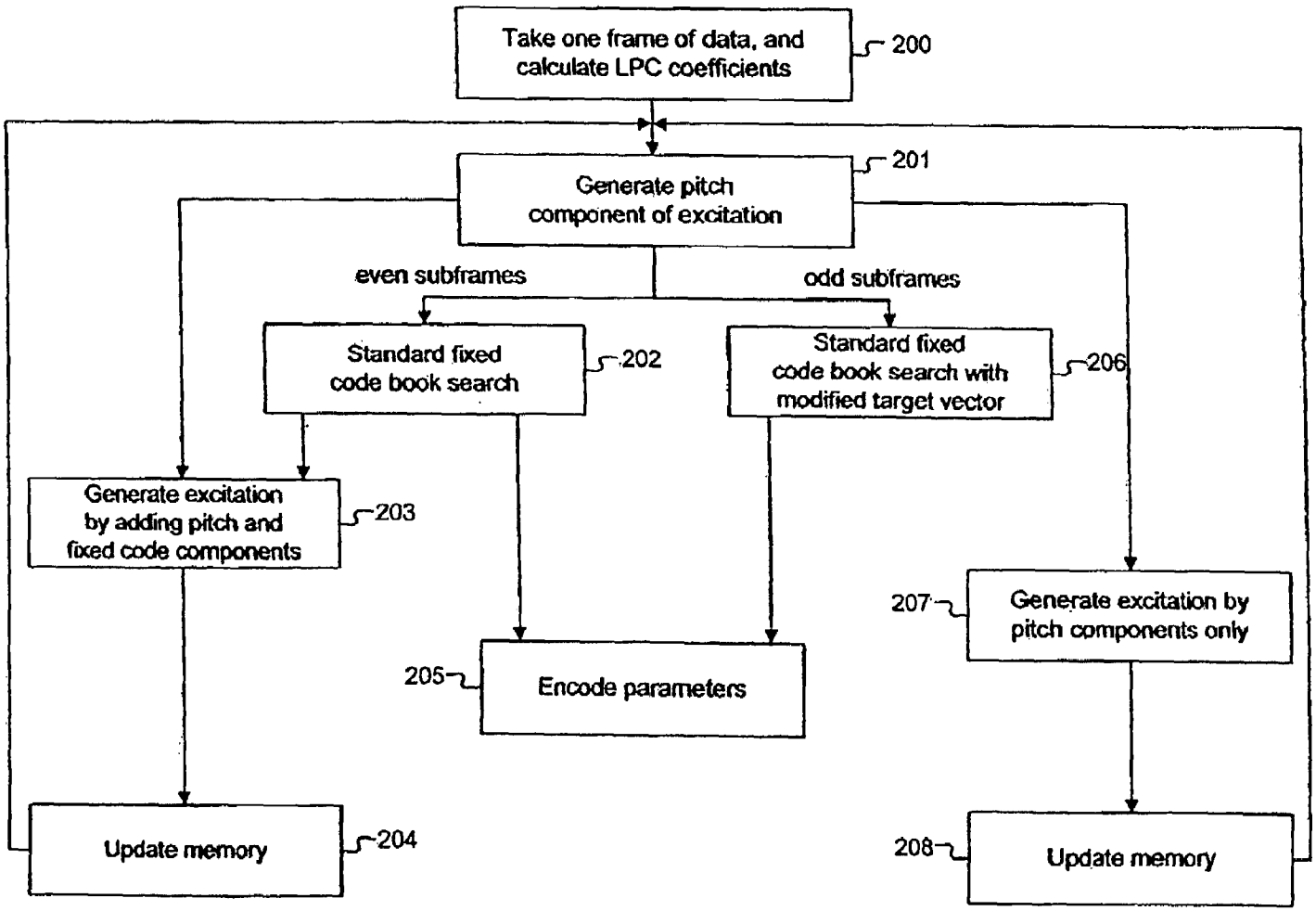
FIG. 2 is a flowchart showing an encoding process consistent with one embodiment of the present invention.

FIG. 2 is a flowchart showing an example of a modified algorithm for encoding one frame of data consistent with one embodiment of the present invention. A controller 114 shown in FIG. 1 may control each element in encoder 100 according to the flowchart. Referring to FIG. 2, one frame of data is taken and LPC coefficients are calculated at step 200. A pitch component of excitation of a sub-frame is generated at step 201. In one embodiment, the pitch component is generated by adaptive codebook 104 and amplifier 106 shown in FIG. 1. When the sub-frame is an even sub-frame, a standard fixed codebook search is performed at step 202. The standard codebook search may be performed using fixed codebook 105 and amplifier 107 of FIG. 1 in one embodiment. The searched results are encoded at step 205. In one embodiment, the search results are provided to parameter encoding device 110 for encoding. In addition, the pitch component of excitation generated at step 201 is added at step 203 to the standard fixed-code component generated from step 202. The result of the addition is provided to LP synthesis filter 103. The excitation generated from step 203 is used to update a memory, such as the adaptive codebook 104, at step 204 for the next sub-frame. These steps correspond to the feedback of the excitation to adaptive codebook 104 shown in FIG. 1.

If the sub-frame is an odd sub-frame, however, a fixed codebook search is performed with a modified target vector at step 206. The modified target vector is further described below. The excitation generated from the pitch component from step 201 is provided to LP synthesis filter 103. The results of the search, along with other parameters, are then encoded at step 205. In one embodiment, the results are provided to parameter encoding device 110. As a modification in the coding algorithm, however, a different excitation is used to update the memory at step 208, contrary to method described above for updating the memory at step 204. The different excitation is generated from the pitch component generated from step 201 only. The results generated at step 206 are ignored.

The odd sub-frame pulses are controlled at step 208 so that the pulses are not recycled between sub-frames. Since the encoder has no information about the number of odd sub-frame pulses actually used by the decoder, the encoding algorithm is determined by assuming the worst case scenario in which the decoder receives only the basic bit stream. Thus, the excitation vector and the memory states without any odd sub-frame pulses are passed down from an odd sub-frame to the next even sub-frame. The odd sub-frame pulses are still searched at step 206 and generated at step 207 so that they may be added to the excitation for enhancing the speech quality of the sub-frame generated at step 205.

To ensure consistency of the closed-loop analysis-by-synthesis method, the odd sub-frame pulses are not recycled for the subsequent sub-frames. If the encoder recycles any of the odd sub-frame pulses not used by the decoder, the code vectors selected for the next sub-frame might not be the optimum choice for the decoder and an error would occur. This error would then propagate and accumulate throughout the subsequent sub-frames on the decoder side and eventually cause the decoder to break down. The modifications described in step 208 and related steps serve, in part, to prevent error.

The modified target vector is also used in step 206 to smooth certain discontinuity effects caused by the above-described non-recycled odd sub-frame pulses processed in the decoder. Since the speech components generated from the odd sub-frame pulses to enhance the speech quality are not fed back through LP synthesis filter 103 or error vector processor 109 in the encoder, the components would introduce a degree of discontinuity at the sub-frame boundaries in the synthesized speech if used in the decoder. The effect of discontinuity can be minimized by gradually reducing the effects of the pulses on, for example, the last ten samples of each odd sub-frame, because ten speech samples from the previous sub-frame are needed in a tenth-order LP synthesis filter.

Specifically, since the LPC-filtered pulses are chosen to best mimic a target vector in the analysis-by-synthesis loop, target vector processor 108 linearly attenuates the magnitude of the last N samples of the target vector, where N is the number of tap of the synthesis filter, prior to the fixed codebook search of each odd sub-frame in step 206. This modification of the target vector not only reduces the effects of the odd sub-frame pulses but also ensures the integrity of the well-established fixed codebook search algorithm.

Figure 3:
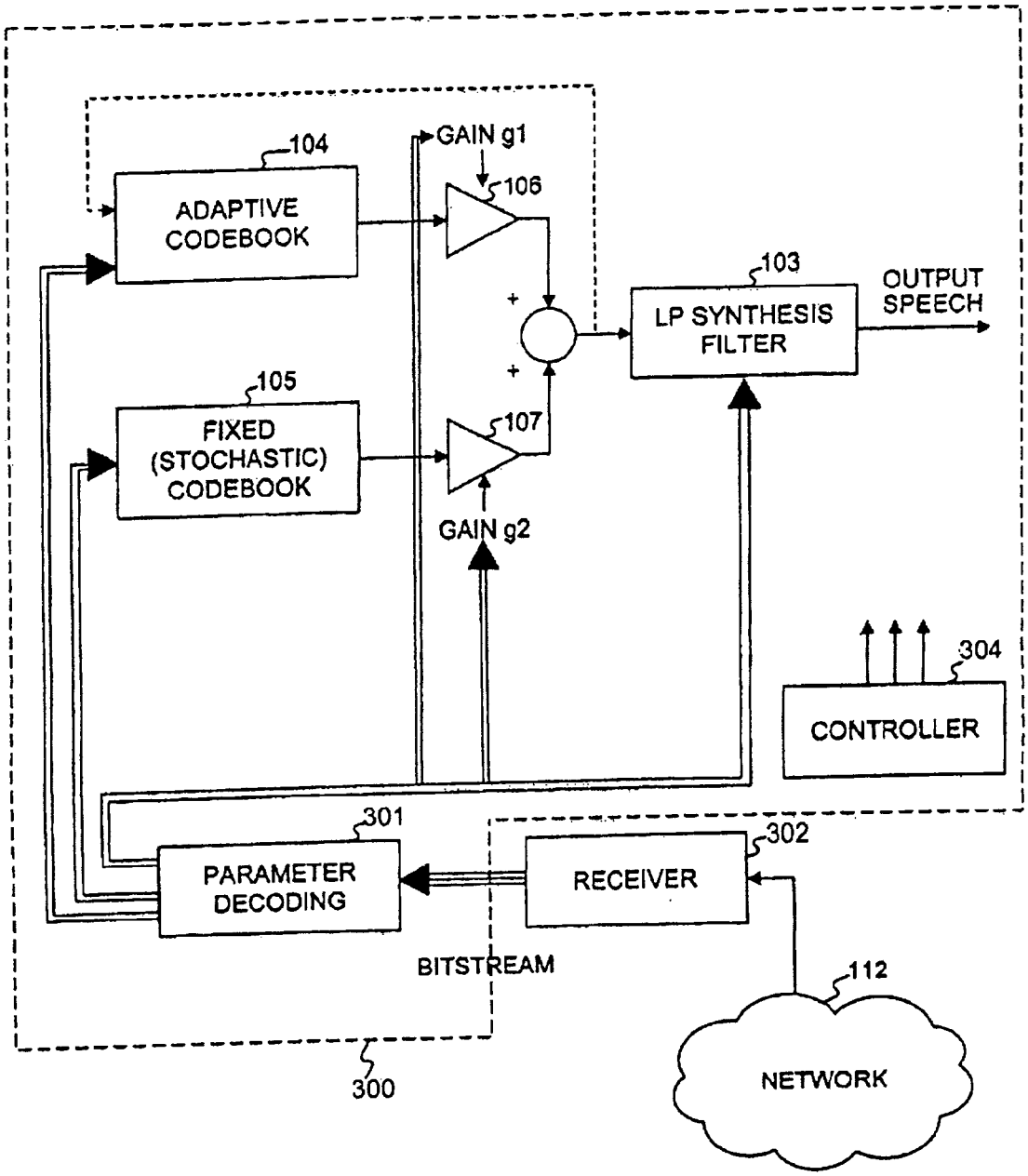
FIG. 3 is a block diagram illustrating an embodiment of a speech decoder consistent with the present invention.

FIG. 3 is a block diagram of an embodiment of a CELP-type decoder 300 consistent with the present invention. Referring to FIG. 3, decoder 300 includes adaptive codebook 104, fixed codebook 105, amplifiers 106 and 107, and LP synthesis filter 103, the same components as those with the same reference numbers shown in FIG. 1 and they will not be described herein further. Decoder 300 is designed to be compatible with encoder 100 shown in FIG. 1, at least in the analysis-by-synthesis loop.

Referring again to FIG. 3, decoder 300 further includes a parameter decoding device 301. In one embodiment, parameter decoding device 301 is provided external to decoder 300. All or part of the bit stream is provided to parameter decoding device 301 to decode the received bit stream. Parameter decoding device 301 then outputs the decoded LPC coefficients to LP synthesis filter 103, the pitch lag/gain to adaptive codebook 104, and in turn, amplifier 106, for every sub-frame. Parameter decoding device 301 also provides the stochastic code/gain to fixed codebook 105 and, in turn, amplifier 107, for each even sub-frame. The stochastic codes/gains of odd sub-frames are provided to fixed codebook 105, and, in turn, amplifier 107, if these parameters are contained in the received bit stream. Then, an excitation generated by adaptive codebook 104 and amplifier 106 and an excitation generated by fixed codebook 105 and amplifier 107 are added, and synthesized into an output speech by LP synthesis filter 103.

Figure 4:
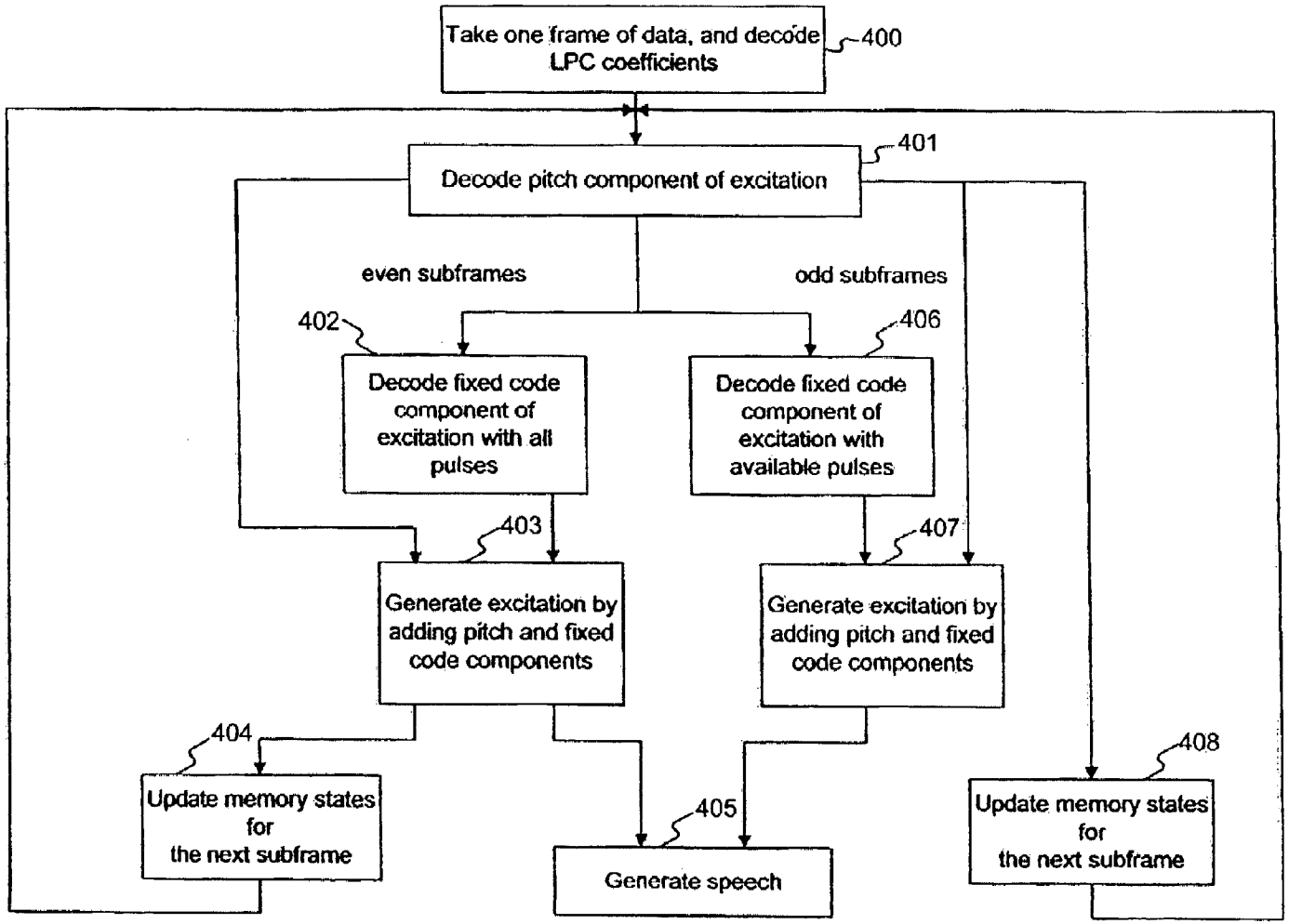
FIG. 4 is a flowchart showing a decoding process consistent with one embodiment of the present invention.

FIG. 4 is a flowchart showing an example of a decoding algorithm consistent with one embodiment of the present invention. A controller 304 shown in FIG. 3 may control each element in decoder 300 according to the decoding algorithm of FIG. 4.

With reference to FIG. 4, the method begins at step 400 by taking one frame of data and decoding the LPC coefficients. Then, the pitch component of excitation for a specified sub-frame is decoded at step 401. If the specified sub-frame is an even sub-frame, a fixed-code component of excitation with all pulses is generated at step 402. The excitation is generated by adding the pitch component decoded from step 401 and the fixed-code component decoded from step 402. In one embodiment, the result of the addition is provided to LP synthesis filter 103 shown in FIG. 3. The excitation generated from step 403 is used to update memory states for the next sub-frame at step 404. This corresponds to feedback loop of the excitation to adaptive codebook 104 shown in FIG. 3. The output speech is then generated at step 405. In reference to FIG. 3, LP synthesis filter 103 generates the output speech from the excitation generated at step 403.

If the specified sub-frame is an odd sub-frame, a fixed-code component of excitation with available pulses is decoded at step 406. The number of available pulses depends on the number of enhancement bit streams received, excluding the basic bit stream. The excitation is generated by adding the pitch component generated from step 401 and the fixed-code component generated from step 406 at step 407. The output speech is then generated at step 405. The addition can be provided to LP synthesis filter 103 in FIG. 3 to provide the synthesized output speech. Similarly to encoder 100 shown in FIG. 1, decoder 300 is modified such that the excitation generated from step 407 is not used to update the memory states for the next sub-frame. That is, the fixed-code components of any odd sub-frame pulses are removed, and the pitch component of the current odd sub-frame is used to update the next even sub-frame at step 408.

With the above-described coding system and with reference to FIG. 1, encoder 100 encodes and provides full bit stream to a channel supervisor (not shown). In one embodiment, the channel supervisor may be provided in transmitter 111. The supervisor can discard up to 42 bits from the end of the full bit stream, depending on the channel traffic in network 112.

Referring also to FIG. 3, receiver 302 receives the non-discarded bits from network 112 and provides the received bits to decoder 300 to decode the bit stream on the basis of each pulse and according to the number of the bits received. If the number of enhancement bit stream received is insufficient to decode one specific pulse, the pulse is abandoned. This method leads to a resolution of about 3 bits in a frame having between 118 bits and 160 bits, or a resolution of 0.1 kbit/s within the bit rate range from 3.9 kbit/s to 5.3 kbit/s. These numbers are used when the above-described coding scheme is applied to the low rate codec of G.723.1. For other CELP-based speech codecs, the number of bits and the bit rates will be different.

Figure 5:
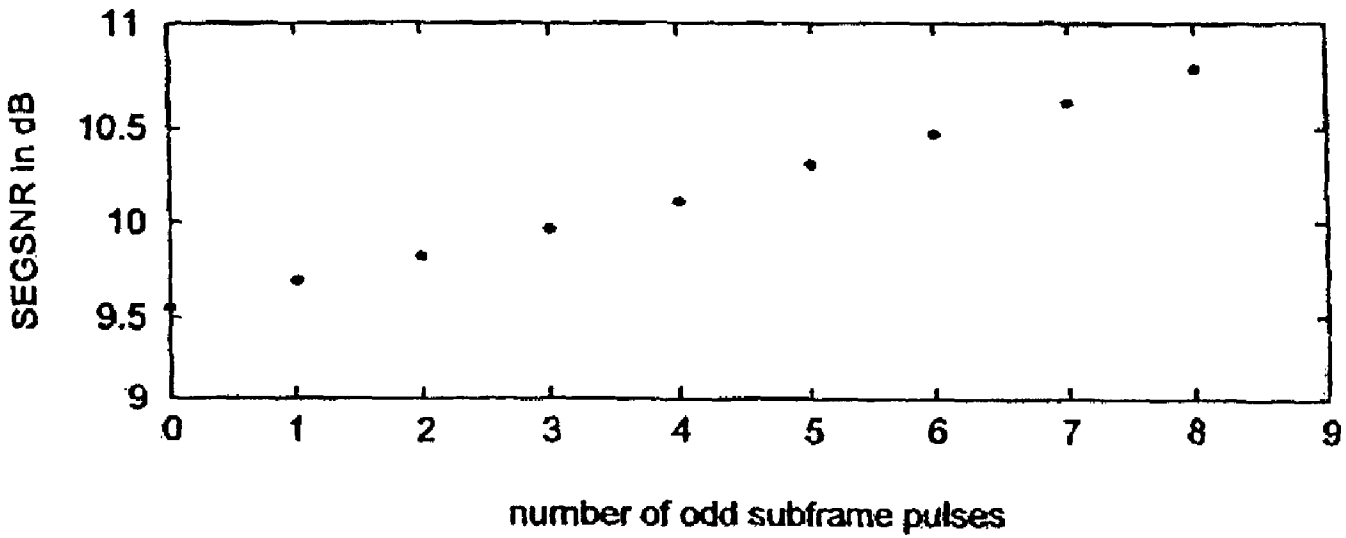
FIG. 5 is a chart showing an example of scalability provided in accordance with the present invention.

With this implementation, the FGS is realized without additional overhead or heavy computational loads because the full bit stream consists of the same elements as the standard codec. Moreover, within a reasonable bit rate range, a single set of encoding schemes is sufficient for each one of the FGS-scalable codecs. An example of the realized scalability in a computer simulation is shown in FIG. 5. In this example, the above-described embodiments were applied to the low rate coder of G.723.1, and a 53-second speech was used as a test input. The 53-second speech is distributed with ITU-T G.728. The worst case with the speech quality decoded by such a FGS scalable codec is when all 42 enhancement bit streams are discarded. As pulses are added, the speech quality is expected to improve. In the performance curve shown in FIG. 5, the SEGSNR values of each decoded speech are plotted against the number of pulses used in sub-frame 1 and 3.

With each odd sub-frame being allowed four pulses and the bits being assembled in the manner shown in Table 2, if the number of odd sub-frame pulses is greater than four but less than eight, the missing pulses are determined as from sub-frame 3. If the number of pulses is less than four, the pulses obtained are all from sub-frame 1. In the worst case when the pulse number is zero, no pulses are used by the decoder in any odd sub-frame. The graph shown in FIG. 5 demonstrates that the speech quality depends on the number of enhancement bit stream made available to the decoder.

Henceforth, the speech codec is scalable.

Figure 6:
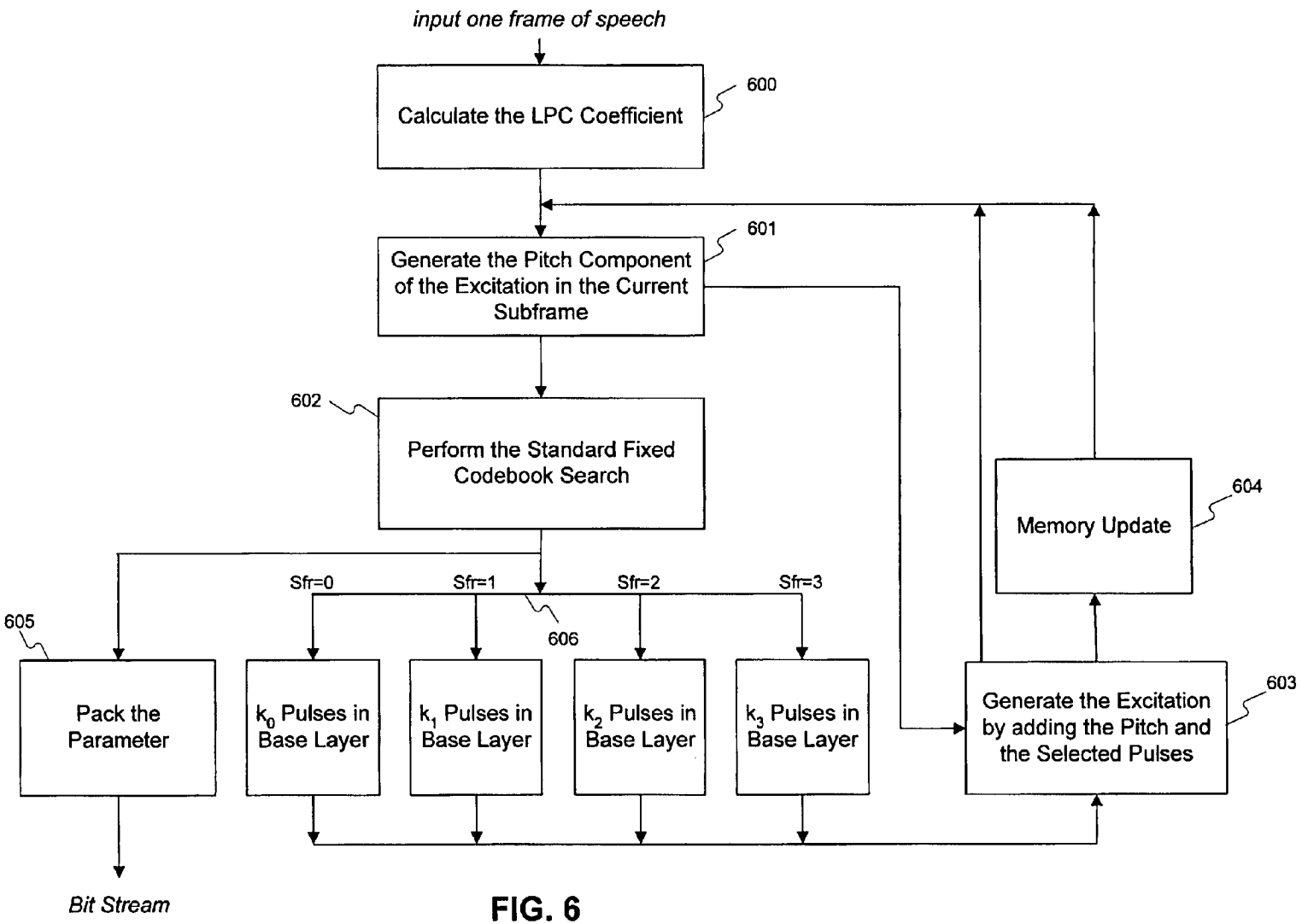
FIG. 6 is a flowchart showing an encoding process consistent with another embodiment of the present invention.
Figure 7:
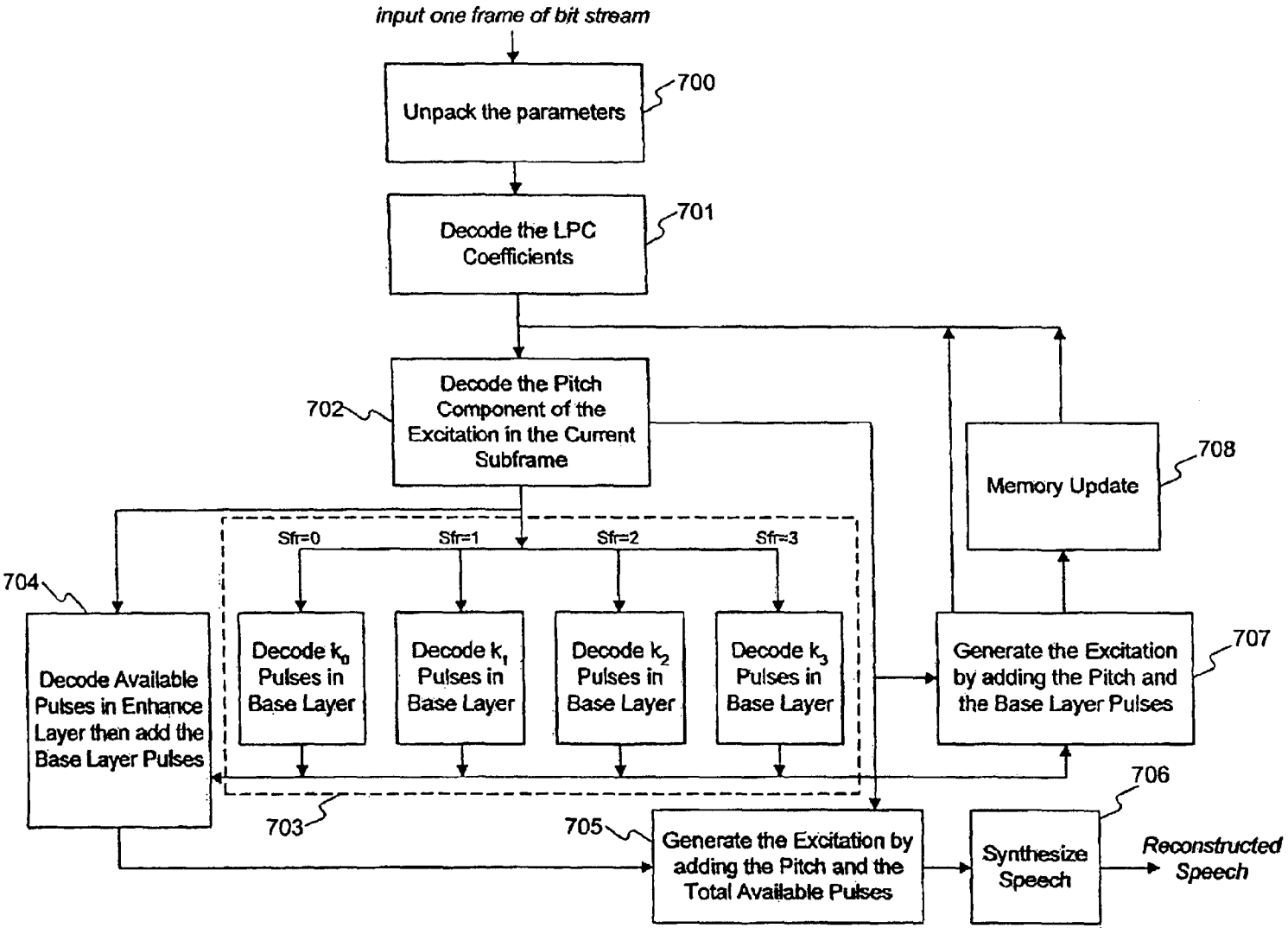
FIG. 7 is a flowchart showing a decoding process consistent with another embodiment of the present invention.

Also in accordance with the present invention, there is provided a novel encoding scheme: Generalized CELP based FGS Scheme (G-CELP FGS), wherein the enhancement layer is not confined within the odd sub-frames. The enhancement layer may contain pulses from any one or more of the sub-frames, leaving the rest of the pulses in the base layer. FIGS. 6 and 7 are flowcharts showing the encoding and decoding of speech signals according to the G-CELP FGS scheme of the present invention. Controller 114 of FIG. 1 may control each element in encoder 100 according to the flowchart shown in FIG. 6, and controller 304 of FIG. 3 may control each element in decoder 300 according to the flowchart shown in FIG. 7.

For both methods shown and described In FIGS. 6 and 7, it is assumed that a frame of the speech signal is divided into 4 sub-frames, 0, 1, 2, and 3, each sub-frame containing a number of pulses. It is also assumed that the base layer includes $k_0$ pulses from sub-frame 0, $k_1$ pulses from sub-frame 1, $k_2$ pulses from sub-frame 2, and $k_3$ pulses from sub-frame 3. In one aspect, the base layer includes no pulse, and the enhancement layer includes all the pulses from all of the sub-frames. In another aspect, both the base layer and the enhancement layer include at least one pulse from one or more of the sub-frames. In yet another aspect, the base layer includes all the pulses from all of the sub-frames, and the enhancement layer includes no pulse from any sub-frame.

Specifically, the number of pulses of the base layer in each sub-frame may be an arbitrary value equal to or less than the total number of pulses in the sub-frame. Therefore, the number of pulses in the enhancement layer for a given sub-frame is the difference between the total number of pulses and the number of pulses in the base layer in that sub-frame. The number of pulses in the base or enhancement layer of a sub-frame is independent of other sub-frames.

Referring to FIG. 6, the method begins by taking one frame of the speech data and calculating the LPC coefficients for the frame at step 600. The pitch component of excitation for each sub-frame is then generated at step 601. For each pulse of each sub-frame, a fixed codebook search is performed at step 602 to generate pulse-related information, or fixed-code components. In one embodiment, fixed codebook 105 and amplifier 107 are used to perform the search.

At step 606, fixed-code components for the pulses in the base layer are selected. An excitation is generated at step 603 by adding the pitch component from step 601 and the base layer fixed-code components from step 606. The result may be provided to LP synthesis filter 103. The excitation generated from step 603 is used to update the memory states at step 604. This corresponds to feedback of the excitation to adaptive codebook 104 shown in FIG. 1.

The pulses not included in the base layer are included in the enhancement layer. For both the pulses in the base layer and the pulses in the enhancement layer, the fixed-code components generated at 602 are provided to parameter encoding device 110, together with other parameters at step 605. However, the pulse-related information of the enhancement layer pulses is not used to update the memory state. The method of having the pulses in the enhancement layer is similar to the method of odd sub-frames shown in FIG. 2, and therefore is not shown in FIG. 6. The fixed codebook search for the pulses in the enhancement layer may also be performed using a modified target vector, wherein the modified target vector reflects the weighted effects of the last pulses, as already described above. The bit stream generated at step 605 includes a basic bit stream and an enhancement bit stream. The basic bit stream includes the LPC coefficients, the pitch-related information, and the pulse-related information of the pulses in the base layer. The enhancement bit stream includes the pulse-related information of the pulses in the enhancement layer.

Similarly, the pulses in the enhancement layer are not to be recycled. The encoder also assumes the worst case in which the decoder receives only the pulses in the base layer. The enhancement layer pulses are still quantized, i.e., fixed codebook search is still performed to generate excitation to enhance the speech quality. The enhancement layer pulses, however, are not recycled for subsequent sub-frames, preserving the consistency of the closed-loop analysis-by-synthesis method.

Referring to FIG. 7, the method begins by unpacking the parameters in the received frame of data at step 700. The received data should include the basic bit stream and may include a portion or a whole of the enhancement bit stream. The frame of data is decoded at step 701 to generate LPC coefficients, at step 702 to generate pitch components of the sub-frames, and at step 703 to generate fixed-code components of the pulses in the base layer. The frame of data is also decoded at step 704 to generate fixed-code components for available pulses in the enhancement layer, and, also at step 704, the enhancement layer pulses are added to the base layer pulses. An excitation is generated at step 705 by adding the pitch component from step 702, and the fixed-code component of all available pulses from step 704. The generated excitation may be provided to LP synthesis filter 103 to generate a synthesized speech at step 706. On the other hand, the excitation which is used to update the memory state at step 708 is generated at step 707 by adding the pitch component and the fixed-code component of the pulses in the base layer. The procedure at step 708 corresponds to the feedback of the excitation to adaptive codebook 104 as shown in FIG. 3.

According to the above description of embodiments of the present invention with reference to FIGS. 6 and 7, the encoder encodes the speech signal in only one coding flow, i.e., the LPC coefficients, the pitch-related information, and the pulse-related information of all the pulses in both the base layer and the enhancement layer are generated within one loop. Moreover, only the pulses in the base layer are used to update the memory state. The decoder decodes the basic bit stream and whatever is received in the enhancement bit stream. Therefore, the enhancement bit stream may be truncated to arbitrary lengths depending on the bandwidth available to the receiver, i.e., fine granularity scalability is achieved.

Figure 8:
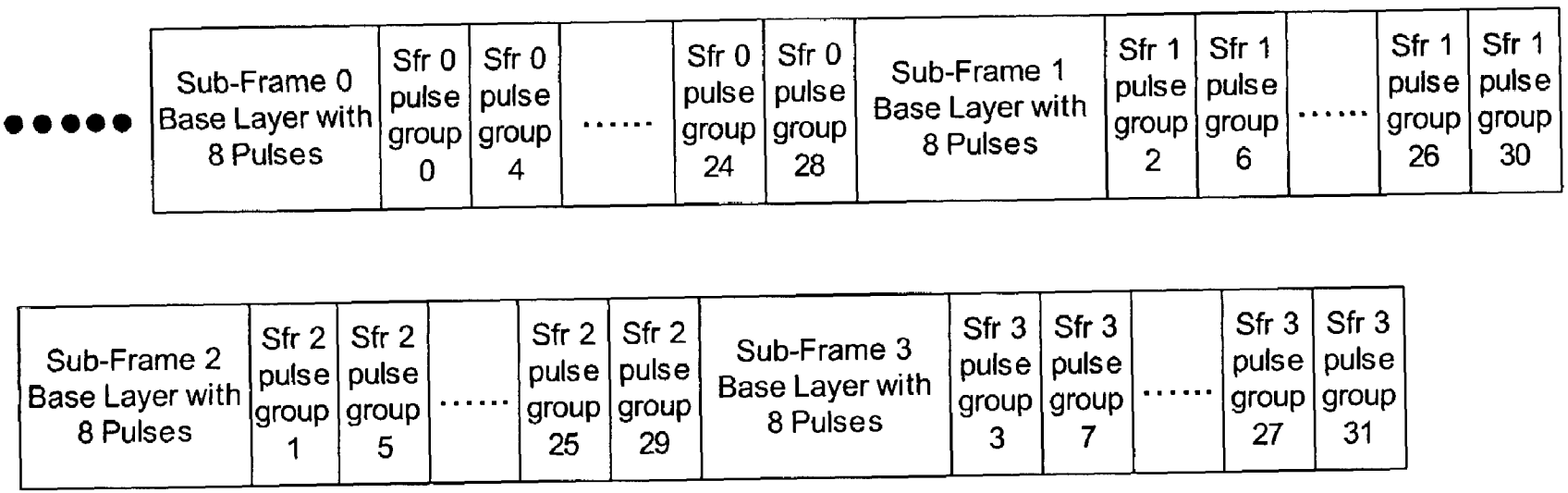
FIG. 8 is an exemplary re-ordering scheme according to the encoding process of FIG. 6.

Because the enhancement layer may contain pulses from not only odd sub-frames, but also even sub-frames, or even all sub-frames, a different re-ordering scheme of the pulses can be presented to further improve the re-constructed speech quality. FIG. 8 shows such a re-ordering scheme.

Referring to FIG. 8, it is assumed that the frame of speech signal is divided into 4 sub-frames, and each sub-frame contains 16 pulses. For each sub-frame, 8 pulses are included in the base layer and the rest are included in the enhancement layer. Therefore, the 8 pulses of each sub-frame in the base layer must be received at the decoder end for an acceptable speech quality, while the other 8 pulses of each sub-frame can be used to improve upon the quality of the synthesized speech. However, the base layer or the enhancement layer may contain a different number of pulses from each sub-frame. Specifically, the number of pulses from each sub-frame in the base layer or the enhancement layer is not limited to 8. Each sub-frame may have a number of pulses other than 8 in the base layer or the enhancement, and the number may be different from and independent of other sub-frames. In one aspect, pulses added to the enhancement layer are chosen from alternating sub-frames, e.g., the first pulse from sub-frame 0, the second from sub-frame 2, the third from sub-frame 1, the fourth from sub-frame 3, and the fifth from sub-frame 0 again, as shown in Table 3. Because the number of pulses in the enhancement layer is not limited by the odd sub-frames and may be any pre-determined number, the G-CELP FGS coding system of the present invention is able to achieve an improved bit rate scalability.

Figure 9:
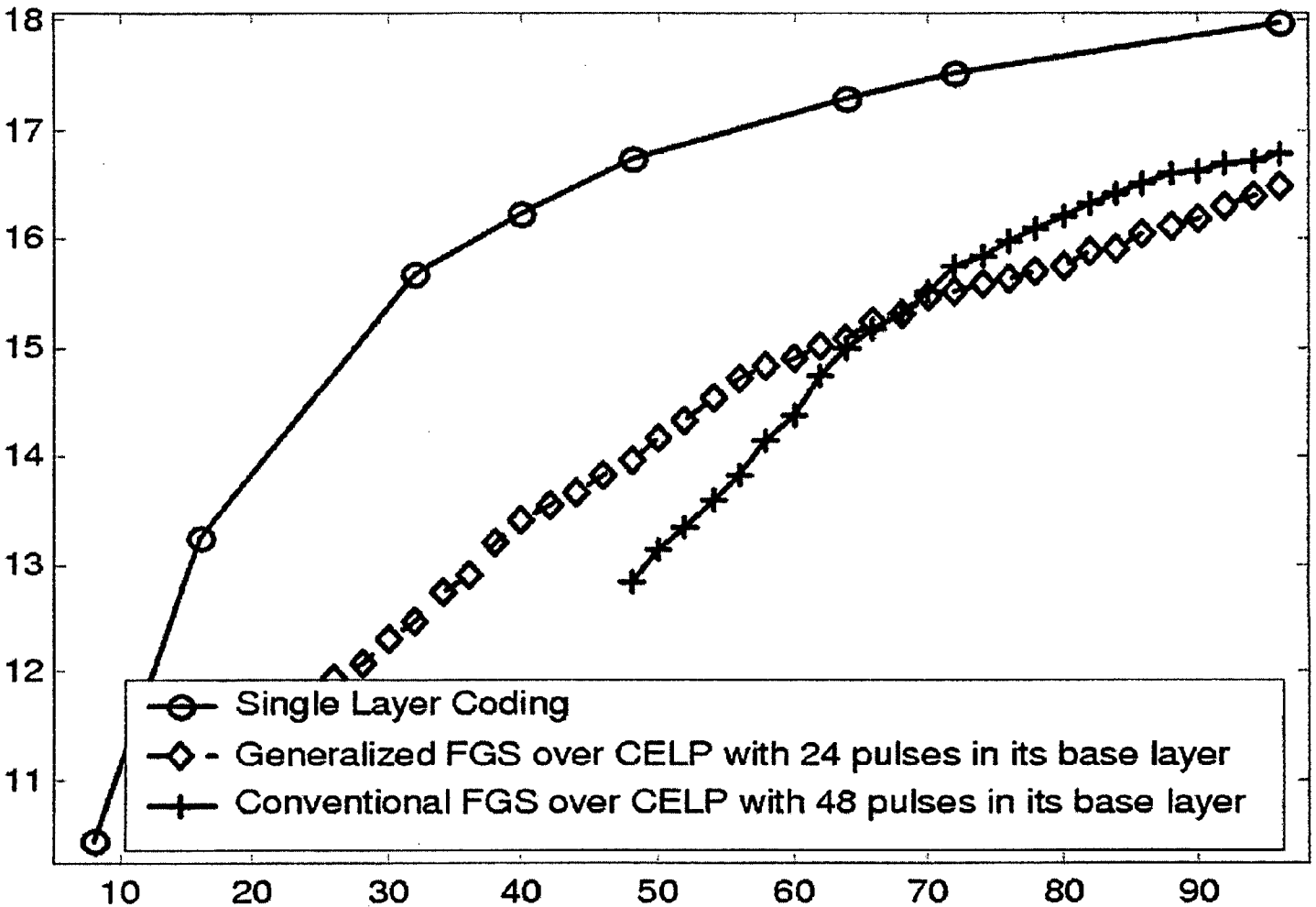
FIG. 9 is a chart showing an example of higher range of scalability provided in accordance with another embodiment of the present invention.

The G-CELP FGS coding method has been simulated on a computer. In this simulation, the conventional single layer coding scheme, FGS over CELP coding scheme, and the G-CELP based FGS coding scheme, are all applied to an AMR-WB system. It is also assumed that there are 96 pulses in a single frame. FIG. 9 shows a plot of the simulated SEGSNR values of each of the three coding schemes against the number of pulses used in each frame. Referring to FIG. 9, the worst case of the G-CELP based FGS coding scheme is when all 72 pulses in the enhancement are discarded. The speech quality improves as enhancement pulses are added. Clearly, G-CELP FGS coding has the better scalability (72 pulses) than CELP based FGS (48 pulses).

In accordance with the present invention, there is also provided a method for transmitting a small amount of non-voice data over the voice channel of an AMR-WB system, or voice band embedded data, without any additional channel, by applying the G-CELP FGS coding scheme in AMR-WB speech coders to realize smaller bit rate gaps between the 9 modes of the AMR-WB standard. Such transmission of the non-voice data over the voice channel can be real time, i.e., one does not have to make another call to receive the non-voice data and the data are received at the destination right away.

For a certain mode of an AMR-WB system, the actual number of pulses per frame transmitted by the encoder and received by the decoder is known, and the whole bit stream generated by the encoder can be received by the decoder. The G-CELP FGS encoding scheme may properly allocate a part of the bandwidth for the to-be-received pulses so that all of the received pulses take part in the analysis-by-synthesis procedure. In one aspect, the rest of bandwidth would be used to transmit non-voice data. This method is explained in detail below.

Figure 10:
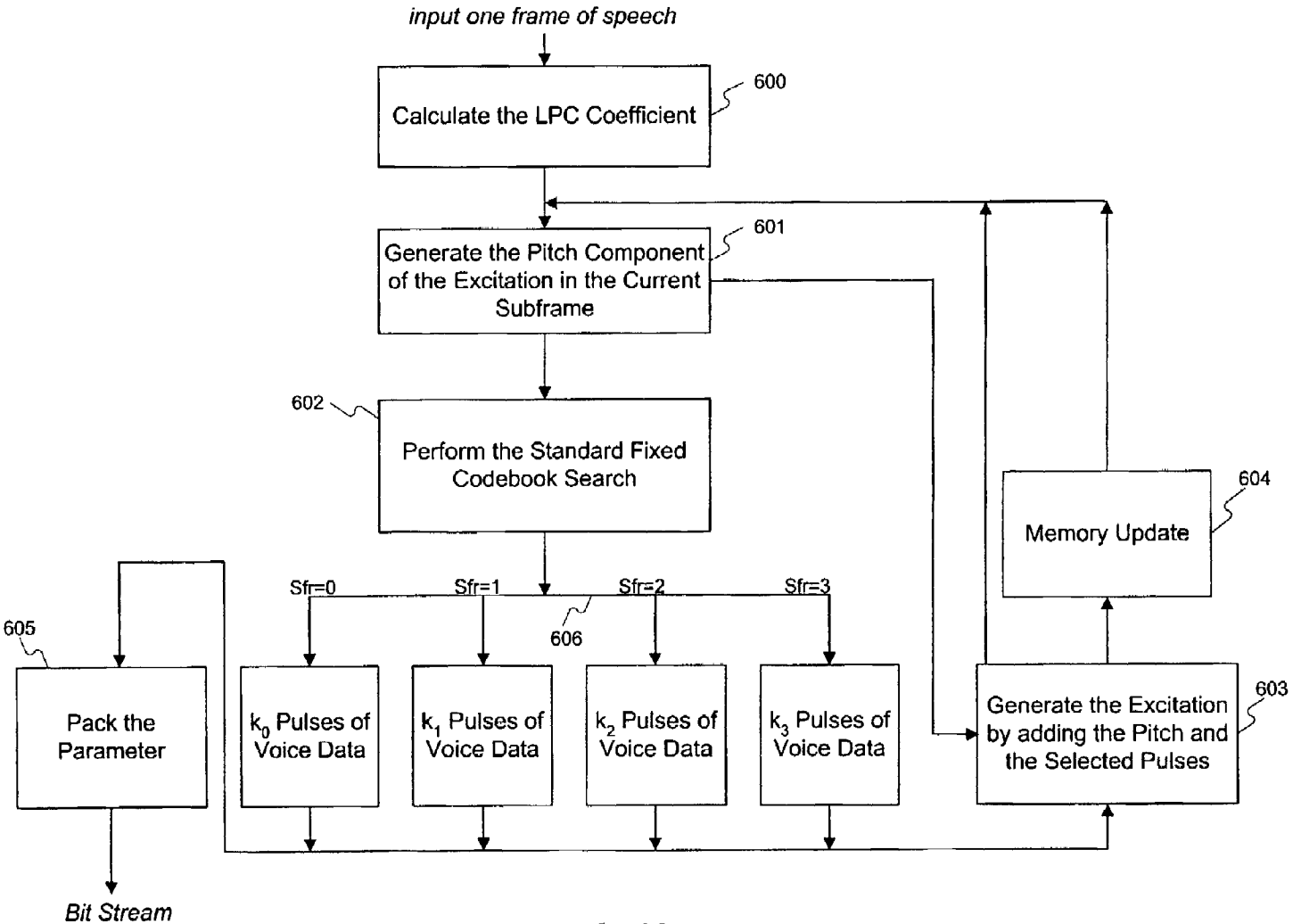
FIG. 10 is a flowchart showing an encoding process modified for imbedding non-voice data in voice band.

Taking the $7^{th}$ mode of the AMR-WB standard as an example, there are 72 fixed-code pulses in a frame. Because it is known that all of the 72 pulses will be transmitted by the encoder and received by the decoder, all the 72 fixed-code pulses participate in the analysis-by-synthesis procedure and are used to update the memory states, i.e., used in generating LPC coefficients, pitch information, and pulse-related information for the next frame, the next sub-frame, or the next pulse. Accordingly, the flowchart shown in FIG. 6 may be modified, as shown in FIG. 10, wherein steps 603 and 604 update the memory states of the system using all the pulses of voice data, and step 605 generates the LPC coefficients, the pitch-related information, and the pulse-related information of all the pulses that represent voice data. In the case of the $7^{th}$ mode, the number of the pulses representing voice data is 72 in total for each frame.

Sub-modes can be obtained by modifying the number of the fixed-code pulses of a mode of the AMR-WB standard. For example, the $8^{th}$ mode corresponds to 96 fixed-code pulses in a frame, or 96 pulses of voice data. Therefore, a sub-mode between the $7^{th}$ and $8^{th}$ modes can be obtained by dropping a certain number of fixed-code pulses from the 96 pulses of the $8^{th}$ mode. However, the encoder still encodes 96 pulses per frame, but only selects and transmits a portion, i.e., less than 96 but more than 72, of the fixed-code pulses. In other words, the sub-mode is generated without modifying the coding procedure of $8^{th}$ mode.

For example, a sub-mode between the $7^{th}$ and the $8^{th}$ modes may include 88 pulses selected by dropping 8 pulses from the 96 pulses generated for the $8^{th}$ mode. Therefore, the bit stream generated for this sub-mode would include the LPC coefficients, the pitch-related information, and the pulse-related information of the selected 88 pulses, and all of the bit stream is used to update memory states of the AMR-WB system, i.e., all of the 88 pulses participate in the analysis-by-synthesis procedure to generate LPC coefficients, pitch information, and pulse-related information for the next frame, the next sub-frame, or the next pulse.

Figure 11:
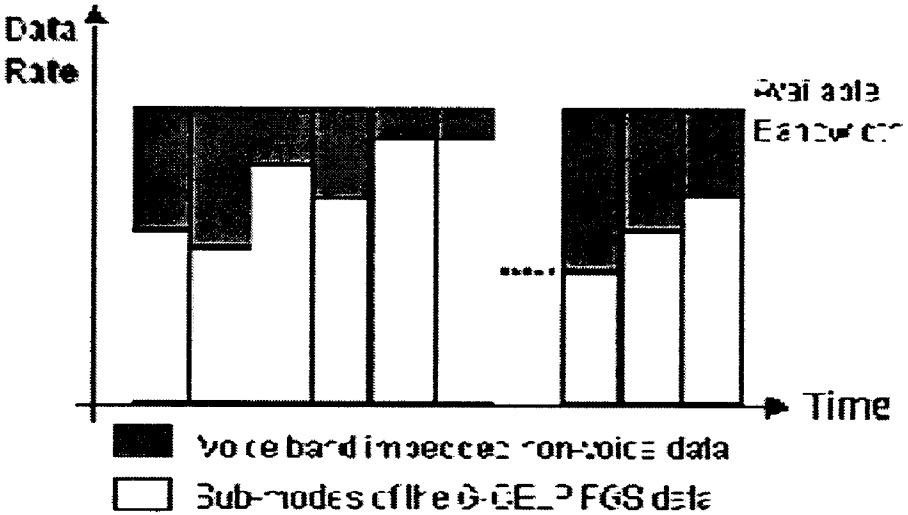
FIG. 11 is a chart showing the allocating of non-voice data in voice band under a limited available bandwidth.

By creating a sub-mode between two modes of the AMR-WB system, for example, the $8^{th}$ and the $7^{th}$ modes, it is possible to transmit voice data over a sub-mode, leaving the freed bandwidth between the $8^{th}$ mode and the sub-mode for transmitting non-voice data. In other words, among the 96 pulses of the $8^{th}$ mode, a number of the pulses, which corresponds to a certain sub-mode, are used to transmit voice data, wherein they are modulated by a speech signal and transmitted, while the rest, which correspond to the dropped pulses when creating the sub-mode, are used to transmit non-voice data, wherein they are modulated by the non-voice data and transmitted. Thus, non-voice data are embedded in a voice band. FIG. 11 shows the fixed available bandwidth for transmitting non-voice data in a voice band after dropping a plurality of pulses from a standard mode of the AMR-WB system.

In one aspect, a plurality of sub-modes are obtained by simultaneously dropping a number of pulses, and keeping the rest of the algorithm essentially unchanged. In another aspect, the pulses to be dropped are chosen from alternating sub-frames, i.e., a first pair from sub-frame 0, a second pair from sub-frame 2, a third pair from sub-frame 1, and a fourth pair from sub-frame 3.

The fixed-code pulses of each AMR-WB mode are searched to identify the best combination for that mode's configuration. The speech quality corresponding to 72 pulses can be obtained by dropping 24 pulses from the $8^{th}$ mode. However, the speech quality thus generated would not be as good as the speech generated by the $7^{th}$ mode. Therefore, only those sub-modes with speech quality better than that of the $7^{th}$ mode are chosen.

Figure 12:
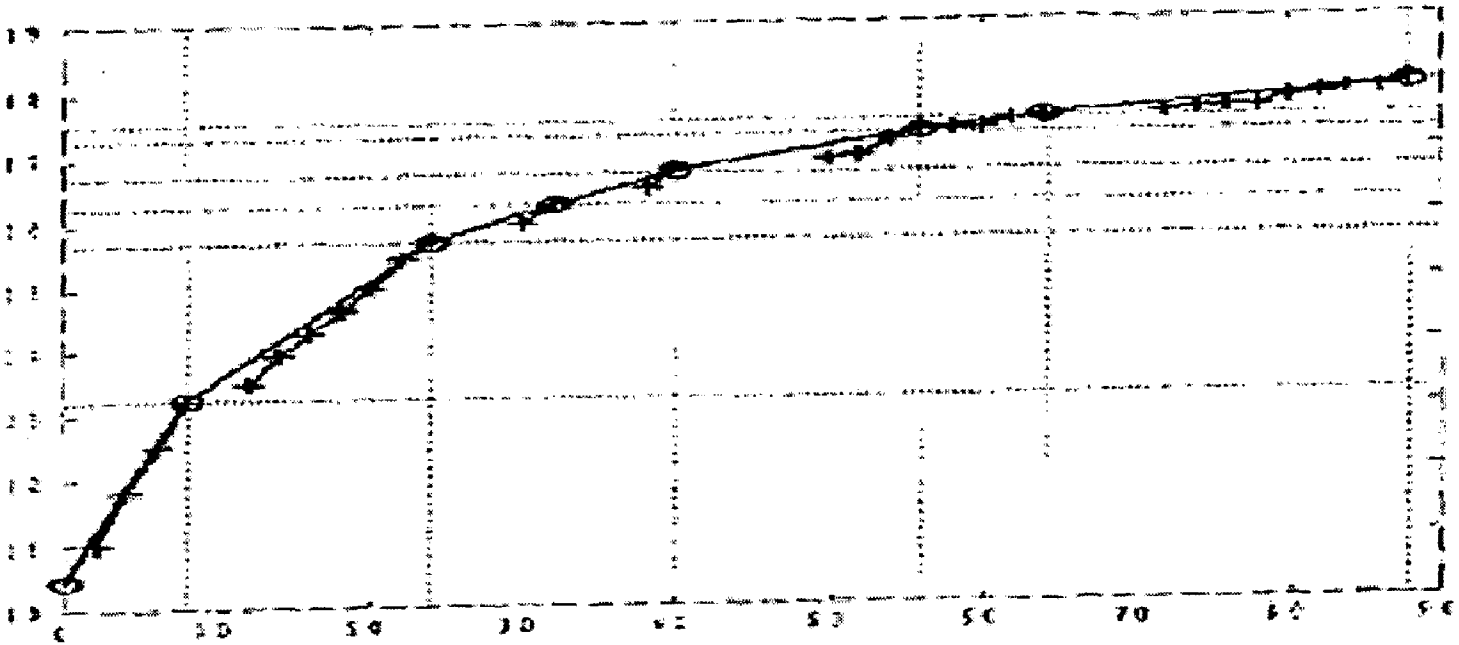
FIG. 12 is a chart showing simulation results of certain sub-modes of AMR-WB standard generated using a method consistent with the present invention.

Similarly, sub-modes between other modes of AMR-WB standard can be obtained using the same method. FIG. 12 shows a simulation result of certain sub-modes of AMR-WB standard according to the present invention. The horizontal axis indicates the number of pulses in each frame. The vertical axis indicates the SEGSNR value. FIG. 12 shows that it is possible to add sub-modes in an AMR-WB codec by simply manipulating the number of pulses to be encoded and decoded, thereby freeing part of the bandwidth so that the freed bandwidth can be used for transmitting a small amount of non-voice data.

Although an AMR-WB system has been used as an example in describing the above technique for transmitting a non-voice data embedded in a voice band, it is to be understood that the same technique may be used in any other system that utilizes a similar encoding scheme for voice data to transmit non-voice data, or in a system that utilizes a similar encoding scheme for transmitting data of one format embedded in another format.

It will be apparent to those skilled in the art that various modifications and variations can be made in the disclosed process without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for speech processing in a code excitation linear prediction (CELP) based speech system having a plurality of modes including at least a first mode and a second mode consecutive with the first mode, comprising:

providing an input speech signal;

dividing the speech signal into a plurality of frames;

dividing at least one of the plurality of frames into sub-frames including a plurality of pulses;

selecting a first number of pulses for the first mode, with a second number of remaining pulses in the frame plus the first number of pulses in the first mode for the second mode;

providing a plurality of sub-modes between the first mode and the second mode, wherein each sub-mode contains a third number of pulses including at least all the pulses in the first mode, and wherein the third number of pulses in the sub-mode are selected by dropping a portion of the pulses in the second mode;

forming a base layer including the first number of pulses;

forming an enhancement layer including the second number of the remaining pulses;

generating a bit stream including a basic bit stream and an enhancement bit stream, including generating linear prediction coding (LPC) coefficients, generating pitch-related information, generating pulse-related information, forming the basic bit stream including the LPC coefficients, the pitch-related information, and the pulse-related information of the pulses in the base layer, and forming the enhancement bit stream including the pulse-related information of the pulses in the enhancement layer, wherein the basic bit stream is used to update memory states of the speech system.

2. The method as claimed in claim 1, wherein the LPC coefficients and the pitch-related information are used to update memory states of the speech system.

3. The method as claimed in claim 1, wherein the pulse-related information of the pulses in the base layer is used to update memory states of the speech system.

4. The method as claimed in claim 1, wherein generating pulse-related information is based on a fixed codebook, and generating pitch-related information is based on an adaptive codebook, wherein the adaptive codebook only contains the information in the basic bit stream.

5. The method as claimed in claim 1, wherein both generating the pitch-related information and generating the pulse-related information comprise minimizing a difference between a synthesized speech and a target signal.

6. The method as claimed in claim 5, wherein the step of minimizing the difference between the synthesized speech and the target signal is looped once for the pulses in each frame to generate the pitch-related information and the pulse-related information for the second number of pulses in the second mode, the first number of pulses from the second mode to form the first mode, and the third number of pulses from the second mode to form the sub-modes.

7. The method as claimed in claim 6, wherein the third number of pulses of each sub-mode are selected by dropping one or more pulses from the second number of pulses in the second mode without the minimization step.

8. The method as claimed in claim 6, wherein the first number of pulses in the first mode are selected by dropping one or more pulses from the third number of pulses of each sub-mode without the minimization step.

9. The method as claimed in claim 1, wherein each sub-mode between the first mode and the second mode corresponds to a second bit stream, wherein the second bit stream is formed by including the basic bit stream and selecting a portion of the enhancement bit stream.

10. The method as claimed in claim 9, wherein the second bit stream includes the pulse-related information of the third number of pulses of each sub-mode, wherein the third number depends on available channel bandwidth.

11. The method as claimed in claim 10, wherein all of the third number of pulses participate in generating a synthesized speech.

12. The method as claimed in claim 1, wherein the plurality of sub-modes include at least a first sub-mode and a second sub-mode, wherein the third number of pulses of the first sub-mode are selected by dropping one or more pulses from the second number of pulses in the second mode, and the third number of pulses of the second sub-mode are selected by dropping one or more pulses from the third number of pulses of the first sub-mode.

13. The method as claimed in claim 11, wherein the pulse dropped between the second mode and the first sub-mode and between consecutive sub-modes are from alternating sub-frames.

14. The method as claimed in claim 13, wherein the pulses dropped from the second mode to constitute the third number of pulses of the first sub-mode are from the first sub-frame, and the pulses dropped from the first sub-mode to constitute the third number of pulses of the second sub-mode are from the third sub-frame.

15. The method as claimed in claim 11, wherein the dropped pulses are used to transmit non-voice data.

16. A method for transmitting non-voice data together with voice data over a voice channel having a fixed bit rate, comprising:

providing an amount of non-voice data;

providing a speech signal to be transmitted over the voice channel;

dividing the speech signal into a plurality of frames;

dividing at least one of the plurality of frames into sub-frames including a plurality of pulses;

selecting a first number of pulses for the first mode, with a second number of pulses remaining in the frame plus the first number of pulses in the first mode for the second mode;

providing a plurality of sub-modes between the first mode and the second mode, wherein each sub-mode contains a third number of pulses including at least all the pulses in the first mode, and wherein the third number of pulses in each sub-mode are selected by dropping a portion of the pulses in the second mode;

forming a base layer including the first number of pulses;

forming an enhancement layer including the second number of pulses;

forming a first bit stream including a basic bit stream and an enhancement bit stream, including generating linear prediction coding (LPC) coefficients, generating pitch-related information, generating pulse-related information for all of the second number of pulses, forming the basic bit stream including the LPC coefficients, the pitch-related information, and the pulse-related information of each pulse in the base layer, selecting one of the sub-modes, and forming the enhancement bit stream including the pulse-related information of the pulses in the selected sub-mode;

forming a second bit stream with the fixed bit rate by including the first bit stream and the amount of the non-voice data; and transmitting the second bit stream.

17. The method as claimed in claim 16, wherein the voice channel is a channel in an AMR-WB system, the first mode and the second mode are standard modes of the AMR-WB system.

18. The method as claimed in claim 17, wherein all of the first bit stream of the selected sub-mode is used to update memory states of an AMR-WB system.

19. The method as claimed in claim 18, further comprising:

providing an amount of non-voice data; and modulating the fourth number of dropped pulses of the selected sub-mode with the non-voice data, transmitting the modulated fourth number of dropped pulses.

20. The method as claimed in claim 18, wherein the third number of pulses of a first sub-mode are selected by dropping one or more pulses from the second mode, and the third number of pulses of a subsequent sub-mode are selected by dropping one or more pulses from a previous sub-mode.

21. The method as claimed in claim 20, wherein the dropped pulses between the first mode and the first sub-mode and between consecutive sub-modes are from alternating sub-frames.

22. The method as claimed in claim 20, wherein the pulses dropped from the second mode to constitute the third number of pulses of the first sub-mode are from the first sub-frame, and the pulses dropped from the first sub-mode to constitute the third number of pulses of a second sub-mode are from the third sub-frame.

23. The method as claimed in claim 16, wherein the second bit stream of each sub-mode includes the pulse-related information of a third number of pulses, and the third number of pulses include all of the first number of pulses and are selected by dropping a fourth number of pulses from the second number of pulses.

* * * * *

UNITED STATES PATENT AND TRADEMARK OFFICE

CERTIFICATE OF CORRECTION

PATENT NO. : 7,272,555 B2
APPLICATION NO. : 10/627629
DATED : September 18, 2007
INVENTOR(S) : I-Hsien Lee et al.

It is certified that error appears in the above-identified patent and that said Letters Patent is hereby corrected as shown below:

On the title page, item 73, "Industrial Technology Research Institute, Taipei (TW)" should read --Industrial Technology Research Institute, Hsinchu (TW)--.

In claim 13, column 16, line 31, "claim 11," should read --claim 12,--.

In claim 15, column 16, line 41, "claim 11," should read --claim 12,--.

Signed and Sealed this

Eighteenth Day of December, 2007

JON W. DUDAS
*Director of the United States Patent and Trademark Office*